US005138661A

United States Patent [19]

Zinser et al.

[11] Patent Number: 5,138,661

[45] Date of Patent: Aug. 11, 1992

[54] LINEAR PREDICTIVE CODEWORD EXCITED SPEECH SYNTHESIZER

[75] Inventors: Richard L. Zinser, Schenectady; Steven R. Koch, Waterford, both of N.Y.

[73] Assignee: General Electric Company, Schenectady, N.Y.

[21] Appl. No.: 612,056

[22] Filed: Nov. 13, 1990

[51] Int. Cl.[5] ..... G10L 5/00

[52] U.S. Cl. ..... 381/35; 381/51

[58] Field of Search ..... 381/51, 35, 31, 38

[56] References Cited

U.S. PATENT DOCUMENTS

| | | | |
|---|---|---|---|
| 4,797,926 | 1/1989 | Bronson et al. | 381/36 |
| 4,827,517 | 5/1989 | Atal et al. | 381/41 |
| 4,868,867 | 9/1989 | Davidson et al. | 381/36 |
| 4,873,724 | 10/1989 | Satoh et al. | 381/40 |
| 4,980,916 | 12/1990 | Zinser | 381/36 |
| 5,060,269 | 10/1991 | Zinser | 381/38 |
| 5,067,158 | 11/1991 | Arjmand | 381/51 |
| 5,073,940 | 12/1991 | Zinser et al. | 381/47 |

OTHER PUBLICATIONS

Markel et al., "A linear Prediction Vocoder Simulation Based Upon the Autocorrelation Method", *IEEE Trans. on Acoustics, Speech, and Signal Processing*, vol. ASSP-22, No. 2, Apr. 1974, pp. 124–134.

Schroeder et al., "Stochastic Coding of Speech Signals at Very Low Bit Rates", *Proc of* 1984 *IEEE Int. Conf. on Communications*, May 1984, pp. 1610–1613.

Schroeder et al., "High-Quality Speech at Very Low Bit Rates", *Proc. of* 1985 *IEEE Int. Conf. on Acoustics, Speech and Signal Processing*, Mar. 1985, pp. 937–940.

Atal et al., "A New Model of LPC Excitation for Producing Natural Sounding Speech at Low Bit Rates", *Proc. of* 1982 *IEEE Int. Conf. on Acoustics, Speech and Signal Processing*, May 1982, pp. 614–617.

*Primary Examiner*—Dale M. Shaw

*Assistant Examiner*—S. A. Melnick

*Attorney, Agent, or Firm*—Marvin Snyder; James C. Davis, Jr.

[57] ABSTRACT

A linear predictive codeword excited speech synthesizer performs a voiced/unvoiced decision to determine the type of excitation to be supplied to a synthesis filter. The synthesizer selects the excitation for voiced speech from a codebook, using an analysis-by-synthesis technique in which the transfer function of a linear predictive coefficient synthesis filter closely resembles the gross spectral shape of the input speech signal. By pitch-periodic repetition of the selected codebook vector, a high quality synthetic speech output is generated.

6 Claims, 6 Drawing Sheets

DECODER

LINEAR PREDICTIVE CODEWORD EXCITED SPEECH SYNTHESIZER

CROSS-REFERENCE TO RELATED APPLICATIONS

This application is related in subject matter to the inventions disclosed in U.S. patent applications:

Ser. No. 07/353,855, filed May 18, 1989, by R.L. Zinser, entitled "HYBRID SWITCHED MULTI-PULSE/STOCHASTIC SPEECH CODING TECHNIQUE" now U.S. Pat. No. 5,060,269;

Ser. No. 07/353,856, filed May 18, 1989, by R.L. Zinser, entitled FOR IMPROVING THE SPEECH QUALITY IN MULTI-PULSE EXCITED PREDICTIVE CODING now U.S. Pat. No. 5,015,464;

Ser. No. 07/427,074, filed Oct. 26, 1989, by R.L. Zinser, entitled "METHOD FOR IMPROVING SPEECH QUALITY IN CODE EXCITED LINEAR PREDICTIVE SPEECH CODING" now U.S. Pat. No. 4,980,916;

Ser. No. 07/441,022, filed Nov. 24, 1989, by R.L. Zinser et al., entitled "A METHOD FOR PROTECTING MULTIPULSE CODERS FROM FADING AND RANDOM PATTERN BIT ERRORS now U.S. Pat. No. 5,073,940; and Ser. No. 07/455,047, filed Dec. 22, 1989, by R.L. Zinser, entitled "FADING BIT ERROR PROTECTION FOR DIGITAL CELLULAR MULTI-PULSE SPEECH CODER" now U.S. Pat. No. 5,097,507.

BACKGROUND OF THE INVENTION

1. Field of the Invention

This invention generally relates to digital voice transmission systems and, more particularly, to a low complexity speech coder.

2. Description of the Prior Art

Code Excited Linear Prediction (CELP) and Multipulse Linear Predictive Coding (MPLPC) are two of the most promising techniques for low rate speech coding. The current Department of Defense (DOD) standard vocoder is the LPC-10 which employs linear predictive coding (LPC). A description of the standard LPC vocoder is provided by J.D. Markel and A.H. Gray in "A Linear Prediction Vocoder Simulation Based Upon The Autocorrelation Method", *IEEE Trans. on Acoustics. Speech, and Sional Processing,* Vol. ASSP-22, No. 2, April 1974, pp. 124–134. While CELP holds the most promise for high quality, its computational requirements can be too great for some systems. MPLPC can be implemented with much less complexity, but it is generally considered to provide lower quality than CELP.

An early CELP speech coder was first described by M.R. Schroeder and B.S. Atal in "Stochastic Coding of Speech Signals at Very Low Bit Rates", *Proc. of* 1984 *IEEE Int. Conf. on Communications.* May 1984, pp. 1610–1613, although a better description can be found in M.R. Schroeder and B.S. Atal, "Code-Excited Linear Prediction (CELP): High-Quality Speech At Very Low Bit Rates", *Proc. of* 1985 *IEEE Int. Conf. on Acoustics, Speech, and Signal Processing,* March 1985, pp. 937–940. The basic technique comprises searching a codebook of randomly distributed excitation vectors for that vector that produces an output sequence (when filtered through pitch and linear predictive coding (LPC) short-term synthesis filters) that is closest to the input sequence. To accomplish this task, all of the candidate excitation vectors in the codebook must be filtered with both the pitch and LPC synthesis filters to produce a candidate output sequence that can then be compared to the input sequence. This makes CELP a very computationally-intensive algorithm, with typical codebooks consisting of 1024 entries, each 40 samples long. In addition, a perceptual error weighting filter is usually employed, which adds to the computational load. A block diagram of a known implementation of the CELP algorithm is shown in FIG. 1, and FIG. 2 shows some example waveforms illustrating operation of the CELP method. These figures are described below to better illustrate the CELP system.

Multi-pulse coding was first described by B.S. Atal and J.R. Remde in "A New Model of LPC Excitation for Producing Natural Sounding Speech at Low Bit Rates", *Proc. of* 1982 *IEEE Int Conf. on Acoustics, Speech. and Signal Processing,* May 1982, pp. 614–617. It was described as an improvement on the rather synthetic quality of the speech produced by the standard DOD LPC-10 vocoder. The basic method is to employ the LPC speech synthesis filter of the standard vocoder, but to excite the filter with multiple pulses per pitch period, instead of the single pulse as in the DOD standard system. The basic multi-pulse technique is illustrated in FIG. 3, and FIG. 4 shows some example waveforms illustrating the operation of the MPLPC method. These figures are described below to better illustrate the MPLPC system.

Currently, and in the past few years, much attention in speech coding research has been focused on achieving high quality speech at rates down to 4.8 Kbit/sec. The CELP algorithm has probably been the most favored algorithm; however, the CELP algorithm is very complex in terms of computational requirements and would be too expensive to implement in a commercial product any time in the near future. The LPC-10 vocoder algorithm is the government standard for speech coding at 2.4 Kbit/sec. This algorithm is relatively simple, but speech quality is only fair, and it does not adapt well to 4.8 Kbit/sec use. The need, therefore, is for a speech coder which performs significantly better than the LPC-10 vocoder, and for other, significantly less complex alternatives to CELP, at 4.8 Kbit/sec rates.

SUMMARY OF THE INVENTION

It is, therefore, an object of the present invention to provide a speech coder that performs well at 4.8 Kbits/-sec, without excessive complexity.

Another object is to provide a speech coder employing a codebook of small enough size that its memory and processing requirements are kept to a practical level.

Briefly, in accordance with a preferred embodiment of the invention, a linear predictive codeword excited synthesizer (LPCES) of speech is provided with features common to both the LPC-10 and CELP coders. Like the LPC-10 coder, the LPCES performs a voiced-/unvoiced decision to determine the type of excitation to be fed to the synthesis filter. Like the CELP coder, the LPCES coder selects the excitation for voiced speech from a codebook, using an analysis-by-synthesis technique. Because of the small size of the codebook used by the LPCES coder, its memory and processing requirements are kept within a practical level. The LPCES coder is more robust than the LPC-10 coder and produces higher quality speech, yet may be implemented with one or two commercial microprocessors.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawing(s) in which:

DETAILED DESCRIPTION OF A PREFERRED EMBODIMENT OF THE INVENTION

Figure 1:
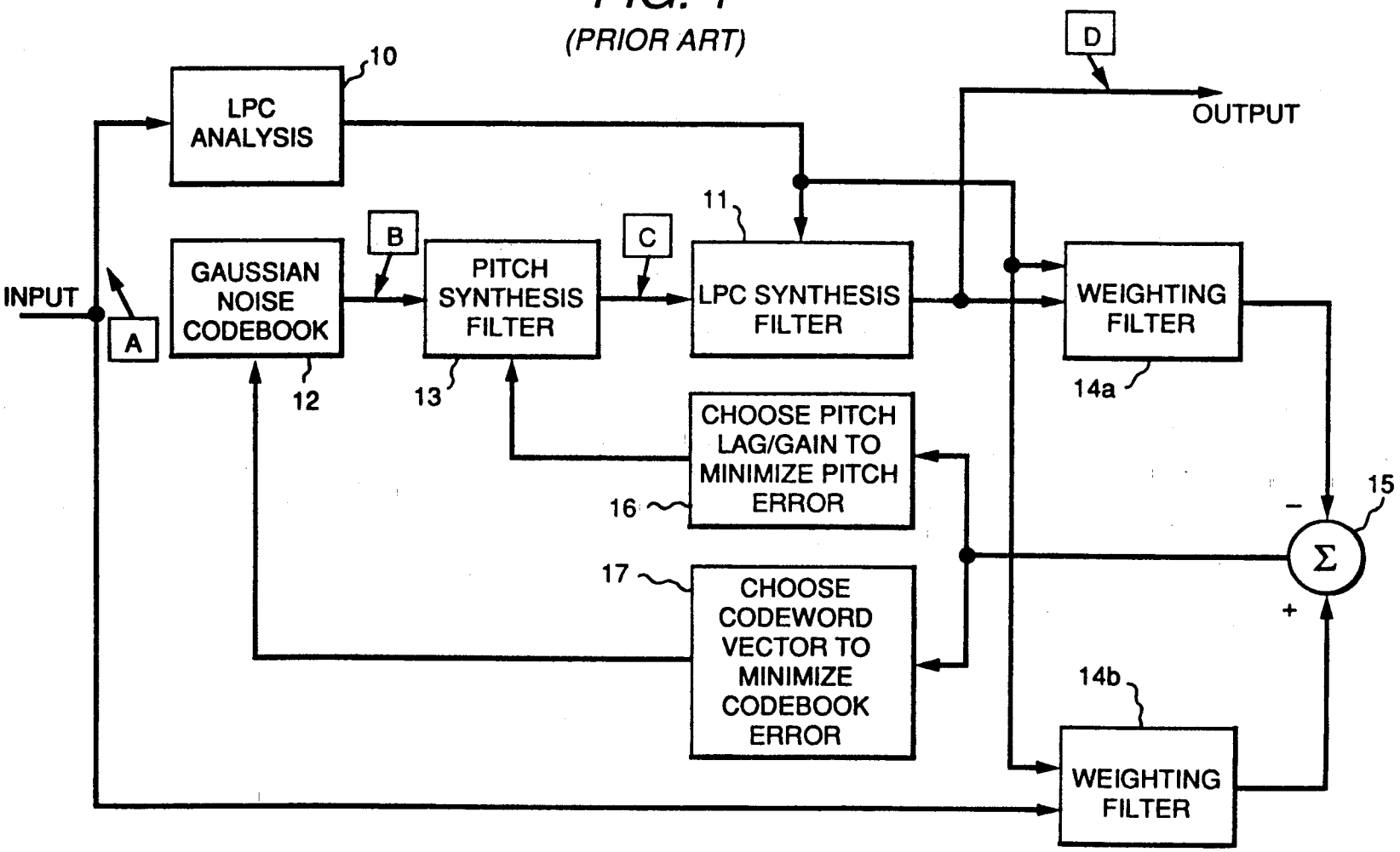
FIG. 1 (PRIOR ART)
FIG. 1 is a block diagram showing a known implementation of the basic CELP technique.
Figure 2:
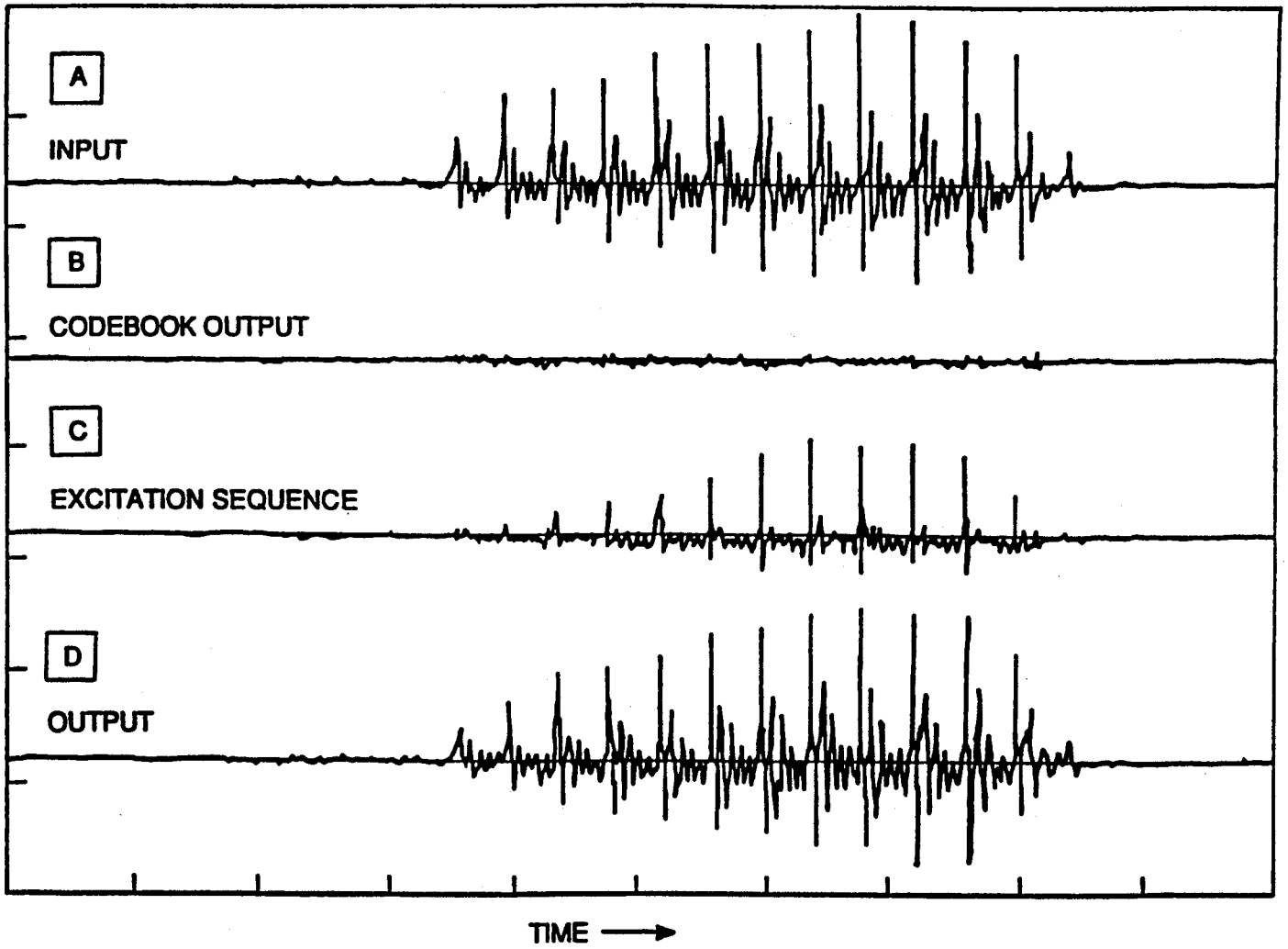
FIG. 2 (PRIOR ART)
FIG. 2 is a graphical representation of signals at various points in the circuit of FIG. 1, illustrating operation of that circuit.

With reference to the known implementation of the basic CELP technique, represented by FIGS. 1 and 2, the input signal at "A" in FIG. 1, and shown as waveform "A" in FIG. 2, is first analyzed in a linear predictive coding analysis circuit 10 so as to produce a set of linear prediction filter coefficients. These coefficients, when used in an all-pole LPC synthesis filter 11, produce a filter transfer function that closely resembles the gross spectral shape of the input signal. Thus the linear prediction filter coefficients and parameters representing the excitation sequence comprise the coded speech which is transmitted to a receiving station (not shown). Transmission is typically accomplished via multiplexer and modem to a communications link which may be wired or wireless. Reception from the communications link is accomplished through a corresponding modem and demultiplexer to derive the linear prediction filter coefficients and excitation sequence which are provided to a matching linear predictive synthesis filter to synthesize the output waveform "D" that closely resembles the original speech.

Linear predictive synthesis filter 11 is part of the subsystem used to generate excitation sequence "C". More particularly, a Gaussian noise codebook 12 is searched to produce an output signal "B" that is passed through a pitch synthesis filter 13 that generates excitation sequence "C". A pair of weighting filters **14*a* and 14*b* each receive the linear prediction coefficients from LPC analysis circuit 10. Filter 14*a* also receives the output signal of LPC synthesis filter 11 (i.e., waveform "D"), and filter 14*b* also receives the input speech signal (i.e., waveform "A"). The difference between the output signals of filters 14*a* and 14*b* is generated in a summer 15 to form an error signal. This error signal is supplied to a pitch error minimizer 16 and a codebook error minimizer 17**.

A first feedback loop formed by pitch synthesis filter 13, LPC synthesis filter 11, weighting filters **14*a* and 14*b*, and codebook error minimizer 17 exhaustively searches the Gaussian codebook to select the output signal that will best minimize the error from summer 15. In addition, a second feedback loop formed by LPC synthesis filter 11, weighting filters 14*a* and 14*b*, and pitch error minimizer 16 has the task of generating a pitch lag and gain for pitch synthesis filter 13, which also minimizes the error from summer 15. Thus the purpose of the feedback loops is to produce a waveform at point "C" which causes LPC synthesis filter 11 to ultimately produce an output waveform at point "D" that closely resembles the waveform at point "A". This is accomplished by using codebook error minimizer 17 to choose the codeword vector and a scaling factor (or gain) for the codeword vector, and by using pitch error minimizer 16 to choose the pitch synthesis filter lag parameter and the pitch synthesis filter gain parameter, thereby minimizing the perceptually weighted difference (or error) between the candidate output sequence and the input sequence. Each of codebook error minimizer 17 and pitch error minimizer 16 is implemented by a respective minimum mean square error estimator (MMSE). Perceptual weighting is provided by weighting filters 14*a* and 14*b***. The transfer function of these filters is derived from the LPC filter coefficients. See, for example, the above cited article by B.S. Atal and J.R. Remde for a complete description of the method.

Figure 3:
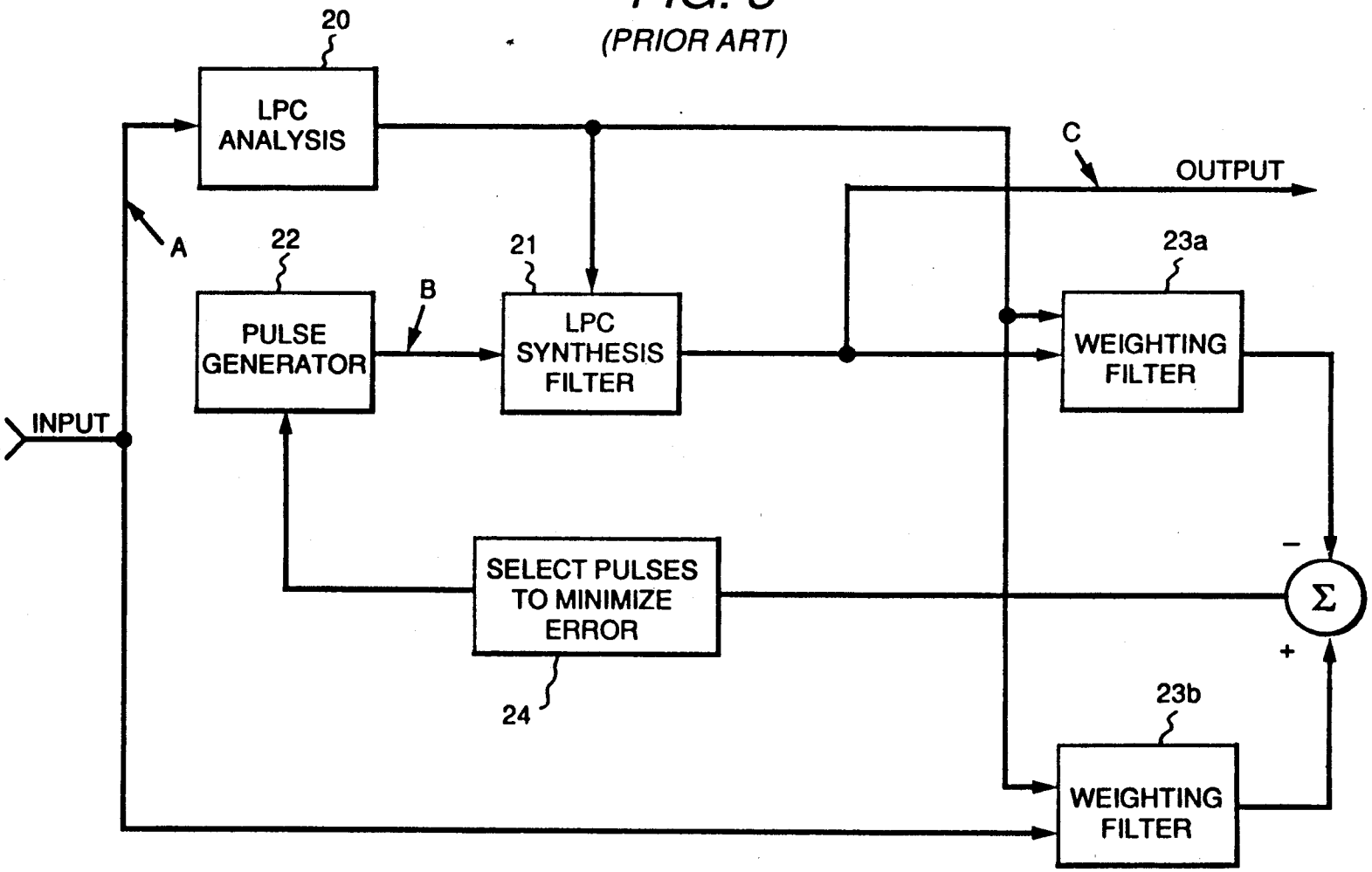
FIG. 3 (PRIOR ART)
FIG. 3 is a block diagram showing implementation of the basic multi-pulse technique for exciting the speech synthesis filter of a standard voice coder.
Figure 4:
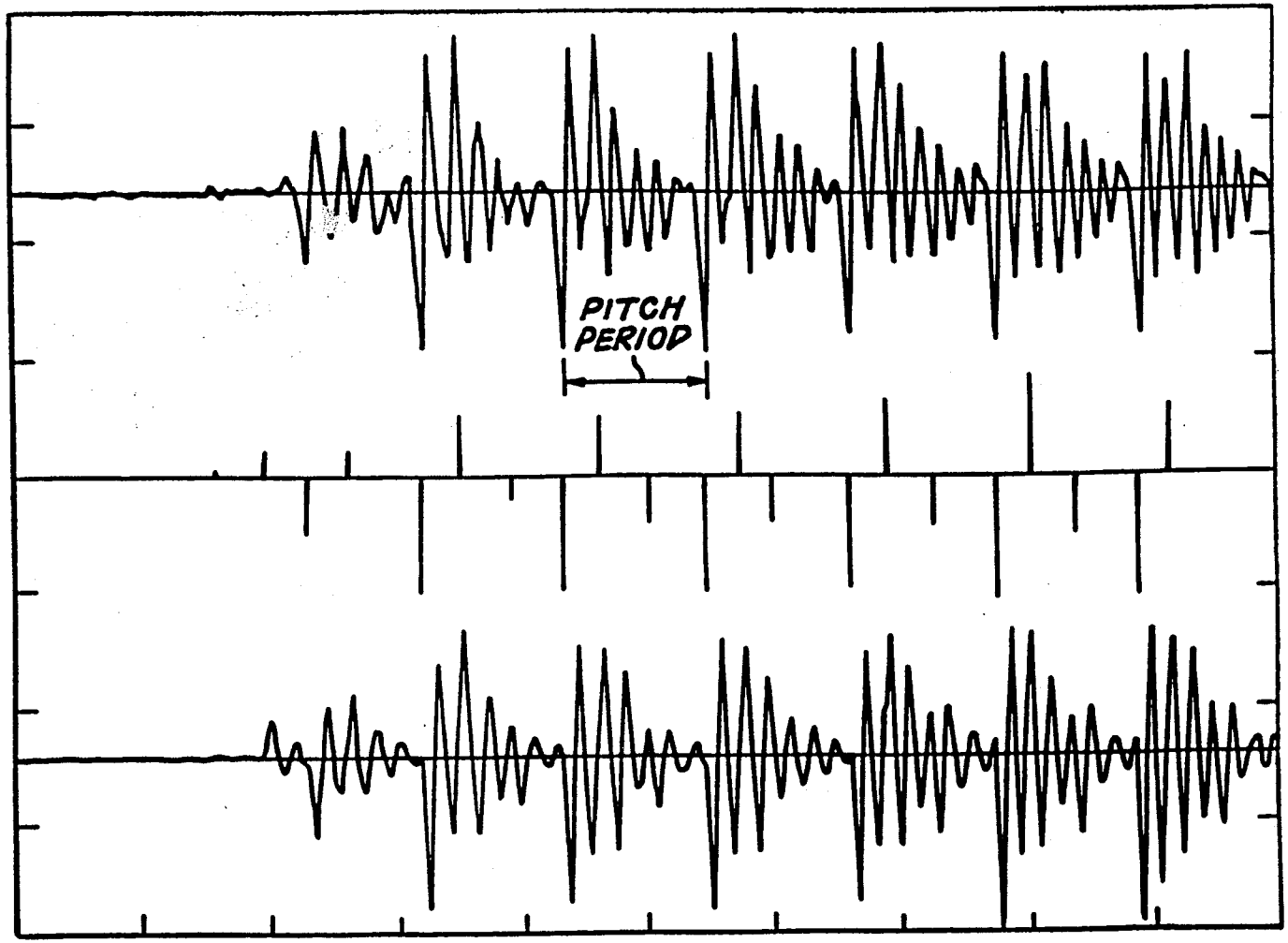
FIG. 4 (PRIOR ART)
FIG. 4 is a graph showing, respectively, the input signal, the excitation signal and the output signal in the system shown in FIG. 3.

In employing the basic multi-pulse technique, as shown in FIG. 3, the input signal at "A" (shown in FIG. 4) is first analyzed in a linear predictive coding analysis circuit 20 to produce a set of linear prediction filter coefficients. These coefficients, when used in an all-pole LPC synthesis filter 21, produce a filter transfer function that closely resembles the gross spectral shape of the input signal. A feedback loop formed by a pulse generator 22, synthesis filter 21, weighting filters **23*a* and 23*b*, and an error minimizer 24 generates a pulsed excitation at point "B"that, when fed into filter 21, produces an output waveform at point "C" that closely resembles the waveform at point "A". This is accomplished by choosing the pulse positions and amplitudes to minimize the perceptually weighted difference between the candidate output sequence and the input sequence. Trace "B" in FIG. 4 depicts the pulse excitation for filter 21, and trace "C" shows the output signal of the system. The resemblance of signals at input "A" and output "C" should be noted. Perceptual weighting is provided by the weighting filters 23*a* and 23*b***. The transfer function of these filters is derived from the LPC filter coefficients. A more complete understanding of the basic multi-pulse technique may be gained from the aforementioned Atal et al. paper.

The linear predictive codeword excited synthesizer (LPCES) according to the invention employs codebook stored "residual" waveforms. Unlike the LPC-10 encoder, which uses a single impulse to excite the synthesis filter during voiced speech, the LPCES uses an entry selected from its codebook. Because the codebook excitation gives a more accurate representation of the actual prediction residual, the quality of the output signal is improved. LPCES models unvoiced speech in the same manner as the LPC-10, with white noise.

Figure 5:
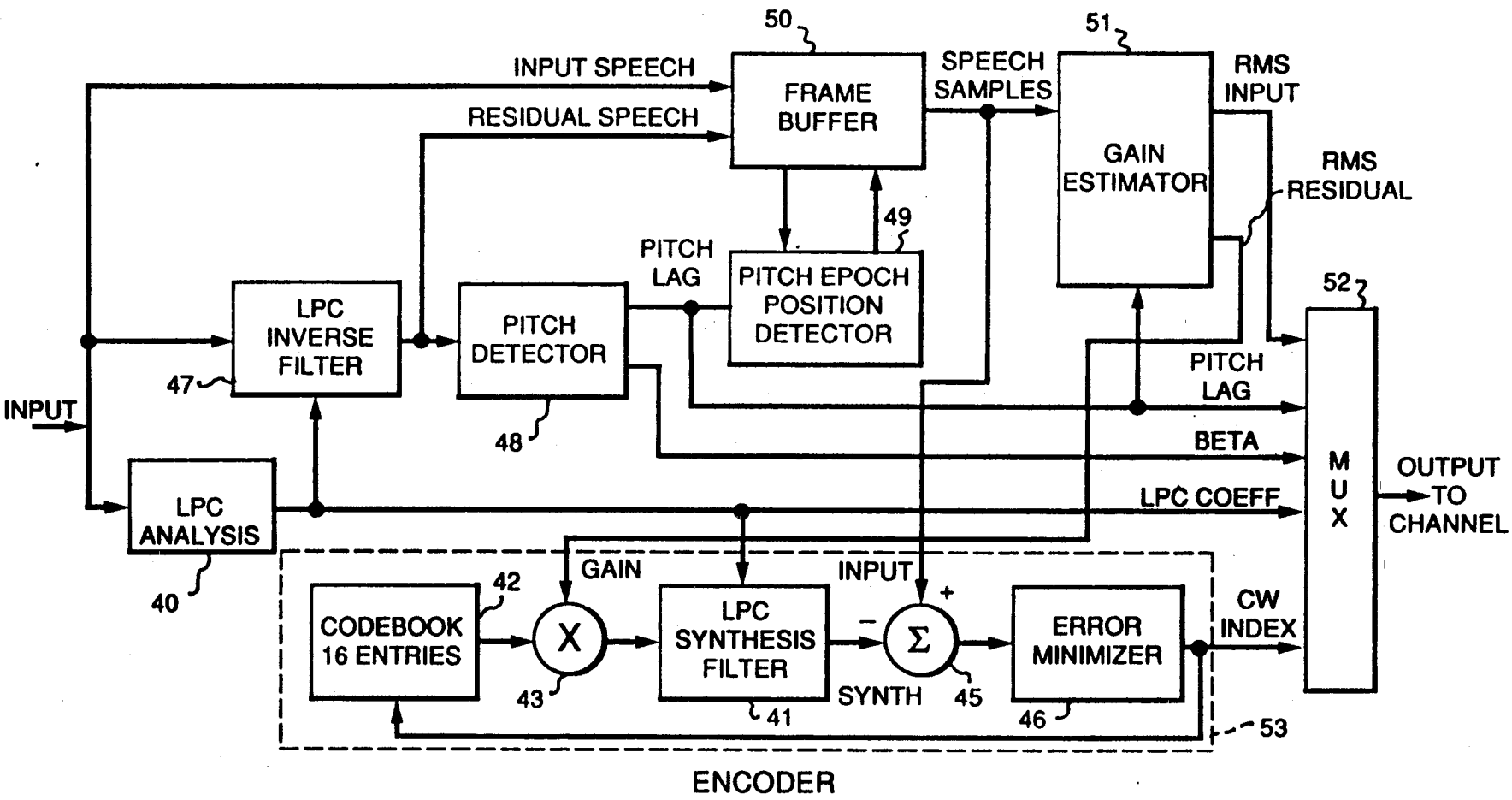
FIG. 5 is a block diagram showing the basic encoder implementing the LPCES algorithm according to the present invention.

FIG. 5 illustrates, in block diagram form, the LPCES encoder according to the present invention. As in the CELP and multipulse techniques described above, the input signal is first analyzed in a linear predictive coding (LPC) analysis circuit 40. This is a standard unit that uses first order pre-emphasis (pre-emphasis coefficient is 0.85), an input Hamming window, autocorrelation analysis, and Durbin's Algorithm to solve for the linear prediction coefficients. These coefficients are supplied to an all-pole LPC synthesis filter 41 to produce a filter transfer function that closely resembles the gross spectral shape of the input signal. A codebook 42 is searched to produce a signal which is multiplied in a multiplier 43 by a gain factor to produce an excitation sequence input signal to LPC synthesis filter 41. The output signal of filter 41 is subtracted in a summer 45 from a speech samples input signal to produce an error signal that is supplied to an error minimizer 46. The output signal of error minimizer 46 is a codeword (CW) index that is fed back to codebook 42. The combination comprising LPC Synthesis filter 41, codebook 42, multiplier 43, summer 45, and error minimizer 46 constitute a codeword selector 53.

Codebook 42 is comprised of vectors that are 120 samples long. It might typically contain sixteen vectors, fifteen derived from actual speech LPC residual sequences, with the remaining vector comprising a single impulse. Because the vectors are 120 samples long, the system is capable of accommodating speakers with pitch frequencies as low as 66.6 Hz, given an 8 kHz sampling rate.

For voiced speech, a new excitation codeword is chosen at the start of each frame, in synchronism with the output pitch period. Only the first P samples of the selected vector are used as excitation, with P indicating the fundamental (pitch) period of the input speech.

The input signal is also supplied to an LPC inverse filter 47 which receives the LPC coefficient output signal from LPC analysis circuit 40. The output signal of the LPC inverse filter is supplied to a pitch detector 48 which generates both a pitch lag output signal and a pitch autocorrelation ($\beta$) output signal. The use of LPC inverse filter 47 is a standard technique which requires no further description for those skilled in the art. Pitch detector 48 performs a standard autocorrelation function, but provides the first-order normalized autocorrelation of the pitch lag ($\beta$) as an output signal. The autocorrelation $\beta$ (also called the "pitch tap gain") is used in the voiced/unvoiced decision and in the decoder's codeword excited synthesizer. For best performance, the input signal to pitch detector 48 from LPC inverse filter 47 should be lowpass filtered (800–1000 Hz cutoff frequency).

The input speech signal and LPC residual speech signal (from filter 47) are supplied to a frame buffer 50. Buffer 50 stores the samples of these signals in two arrays (one for the input speech and one for the residual speech) for use by a pitch epoch position detector 49. The function of the pitch epoch position detector is to find the point where the maximum excitation of the speaker's vocal tract occurs over a pitch cycle. This point acts as a fixed reference within a pitch period that is used as an anchor in the codebook search process and is also used in the initial generation of the codebook entries. The anchor represents the definite point in time in the incoming speech to be matched against the first sample in each codeword. Epoch detector 49 is based on a peak picker operating on the stored input and residual speech signals in buffer 50. The algorithm works as follows: First, the maximum amplitude (absolute value) point in the input speech frame (location $PMAX_{in}$) is found. Second, a search is made between $PMAX_{in}$ and $PMAX_{in}-15$ for an amplitude peak in the residual; this is $PMAX_{res}$. $PMAX_{res}$ is used as a standard anchor point within a given frame.

The output signal of frame buffer 50 is made up of segments of the input and residual speech signals beginning slightly before the standard anchor point and lasting for just over one pitch period. These input speech sample segments and residual speech sample segments, along with the pitch period (from pitch detecto 48), are provided to a gain estimator 51. The gain estimator calculates the gain of the speech input signal and of the LPC speech residual by computing the root-mean-square (RMS) energy for one pitch period of the input and residual speech signals, respectively. The RMS residual speech gain from estimator 51 is applied to multiplier 43 in the codeword selector, while the input speech gain, the pitch and $\beta$ signals from pitch detector 48, the LPC coefficients from LPC analysis circuit 40 and the CW index from error minimizer 46 are all applied to a multiplexer 52 for transmission to the channel.

To understand how codeword selector 53 operates, consideration must first be given to how a codebook is constructed for the LPCES algorithm. To create a codebook, "typical" input speech segments are analyzed with the same pitch epoch detection technique given above to determine the $PMAX_{res}$ anchor point. Codewords are added to a prospective codebook by windowing out one pitch period of source speech material between the points located at $PMAX_{rex}-4$ and $PMAX_{res}-4+P$, where P is the pitch period. The P samples are placed in the first P locations of a codeword vector, with the remaining $120-P$ locations filled with zeros. During actual operation of the LPCES coder, $PMAX_{res}$ is passed directly to the next stage of the algorithm. This stage selects the codeword to be used in the output synthesis.

The codeword selector chooses the excitation vector to be used in the output signal of the LPC synthesizer. It accomplishes this by comparing one pitch period of the input speech in the vicinity of the $PMAX_{res}$ anchor point to one pitch period of the synthetic output speech corresponding to each codeword. The entire codebook is exhaustively searched for the filtered codeword comparing most favorably with the input signal. Thus each codeword in the codebook must be run through LPC synthesis filter 41 for each frame that is processed. Although this operation is similar to what is required in the CELP coder, the computational operations for LPCES are about an order of magnitude less complex because (1) the codebook size for reasonable operation is only twelve to sixteen entries, and (2) only one pitch period per frame of synthesis filtering is required. In addition, the initial conditions in synthesis filter 41 must be set from the last pitch period of the last frame to ensure correct operation.

A comparison operation is performed by aligning one pitch period of the codeword-excited synthetic output speech signal with one pitch period of the input speech near the anchor point. The mean-square difference between these two sequences is then computed for all codewords. The codeword producing the minimum mean-square difference (or MSE) is the one selected for output synthesis. To make the system more versatile and to protect against minor pitch epoch detector errors, the MSE is computed at several different alignment positions near the $PMAX_{res}$ point.

The LPCES voiced/unvoiced decision procedure is similar to that used in LPC-10 encoders, but includes an SNR (signal-to-noise ratio) criterion. Since some codewords might perform very well under unvoiced operation, they are allowed to be used if they result in a close match to the input speech. If SNR is the ratio of codeword RMSE (root-mean-square-error) to input RMS power, then the V/UV (voiced/unvoiced) decision is defined by the following pseudocode:

```
Voiced/Unvoiced_Decision
IUV=0
IF ( ( (ZCN.GT.0.25)
        .AND. (RMSIN.LT.900.0)
        .AND. (BETA.LT.0.95)
        .AND. (SNR.LT.2.0) )
    .OR. (RMSIN.LT.50) ) IUV=1
```

where IUV=1 defines unvoiced operation, ZCN is the normalized zero-crossing rate, RMSIN is the input RMS level, and BETA is the pitch tap gain.

The codeword-excited LPC synthesizer is quite similar to the LPC-10 synthesizer, except that the codebook is used as an excitation source (instead of single impulses). The P samples of the selected codeword are repeatedly played out, creating a synthetic voiced output signal that has the correct fundamental frequency. The codeword selection is updated, or allowed to change, once per frame. Occasionally, the codeword selection algorithm may choose a word that causes an abrupt change in the excitation waveform at the end of a pitch period just after a frame boundary. The "correct" periodicity of the excitation waveform is ensured by forcing period-to-period changes in the excitation to occur no faster than the pitch tap gain would suggest. In other words, the excitation waveform e(i) is given by the following equation:

$$e(i)=\beta e(i-P)+(1-\beta)\text{code}(i,\text{index}), \quad (1)$$

where $\beta$ is the pitch tap gain (limited to 1.0), P is the pitch period, and code (i,index) is the $i^{th}$ sample of codeword number index. This method of enforcing periodicity is known as the "$\beta$-lock" technique. To complete the synthesis operation, the sequence of equation (1) is filtered through the LPC synthesis filter and de-emphasized.

For transmission, the LPC coefficients are converted to reflection coefficients (or partial correlation coefficients, known as PARCORs) which are linearly quantized, with maximum amplitude limiting on RC(3)-RC(10) for better quantization acuity and artifact control during bit errors. ("RC", as used herein, stands for "reflection coefficient"). For this system, the RCs are quantized after the codeword selection algorithm is finished, to minimize unnecessary codeword switching. In addition, a switched differential encoding algorithm is used to provide up to three bits of extra acuity for all coefficients during sustained voiced phonemes. The other transmitted values are pitch period, filter gain, pitch tap gain, and codeword index. The bit allocations for all parameters are shown in the following table.

| | |
|---|---|
| LPC Coefficients | 48 bits |
| Pitch | 6 bits |
| Pitch Tap Gain | 6 bits |
| Gain | 8 bits |

-continued

| | |
|---|---|
| Codeword Index (includes V/UV) | 4 bits |
| Differential Quantization Selector | 2 bits |
| Total | 74 bits |
| Frame Rate (128 samples/frame) | 62.5 frame/sec. |
| Output Rate | 4625 bits/sec. |

Figure 6:
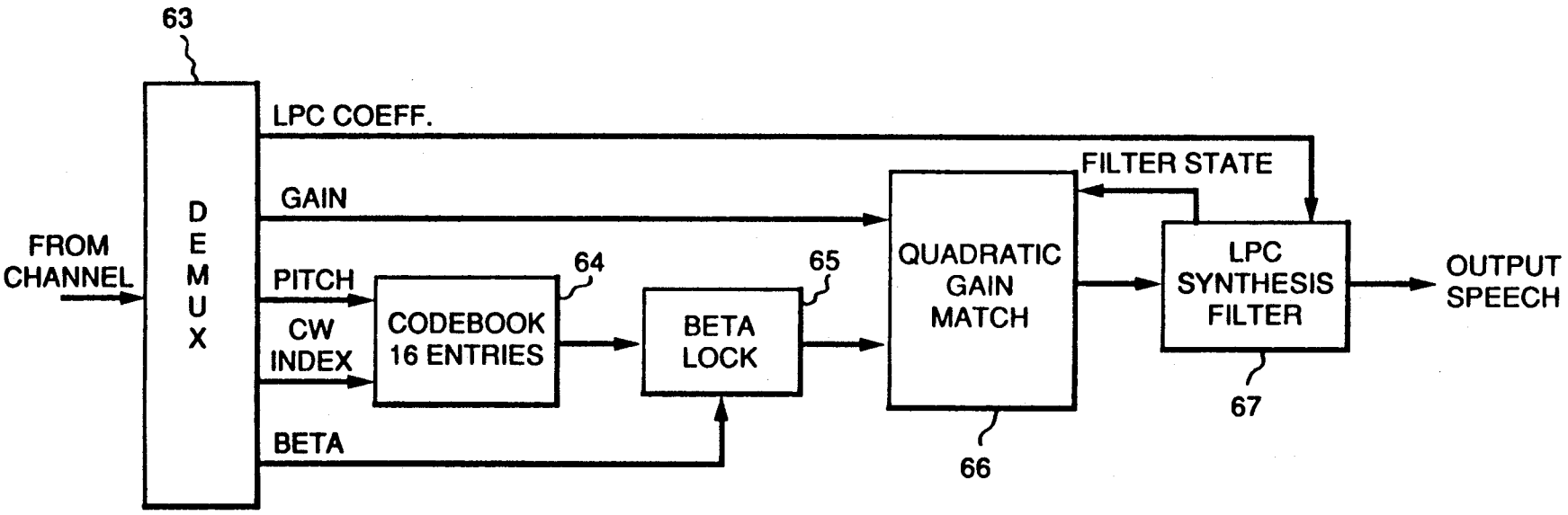
FIG. 6 is a block diagram showing the basic decoder implementing the LPCES algorithm according to the present invention.

As shown in FIG. 6, which represents the LPCES decoder, the signal from the channel is applied to a demultiplexer 63 which separates the LPC coefficients, the gain, the pitch, the CW index, and the beta signals. The pitch and CW index signals are applied to a codebook 64 having sixteen entries. The output signal of codebook 64 is a codeword corresponding to the codeword selected in the encoder. This codeword is applied to a beta lock 65 which receives as its other input signal the $\beta$ signal. Beta lock 65 enforces the correct periodicity in the excitation signal by employing the method of equation (1), above. The output signal of beta lock 65 and the gain signal are applied to a quadratic gain match circuit 66, the output signal of which, together with the LPC coefficients, is applied to an LPC synthesis filter 67 to generate the output speech. The filter state of LPC synthesis filter 67 is fed back to the quadratic gain match circuit to control that circuit.

The quadratic gain match system 66 solves for the correct excitation scaling factor (gain) and applies it to the excitation signal. The output gain ($G_{out}$) can be estimated by solving the following quadratic equation:

$$E_z+2G_{out}C_{ze}+G^2_{out}E_e=E_i, \quad (2)$$

where $E_z$ is the energy of the output signal due to the initial state in the synthesis filter (i.e., the energy of the zero-input response), $C_{ze}$ is the cross-correlation between the output signal due to the initial state in the filter and the output signal due to the excitation (or $C_{ze}$ may be defined as the correlation between the zero-input response and the zero-state response), $E_e$ is the energy due to the excitation only (i.e., the energy of the zero-state response), and $E_i$ is the energy of the input signal (i.e., the transmitted gain for demultiplexer 63). The positive root (for $G_{out}$) of equation (2) is the output gain value. Application of the familiar quadratic equation formula is the preferred method for solution.

The LPCES algorithm has been fully quantized at a rate of 4625 bits per second. It is implemented in floating point FORTRAN. Comparative measurements were made of the CPU (central processor unit) time required for LPC-10, LPCES and CELP. The results and test conditions are given below.

| CPU Time Test Conditions | |
|---|---|
| LPC-10: | 10-th order LPC model, ACF pitch detector |
| LPCES-14: | 10-th order LPC model, 14 × (variable) codebook |
| CELP-16: | 10-th order LPC model, 16 × 40 codebook, 1 tap pitch predictor |
| CELP-1024: | 10-th order LPC model, 1024 × 40 codebook, 1 tap pitch predictor |

Normalized CPU Time to Process 1280 Samples
LPC-10 = 1 unit

| LPC-10 | LPCES-1 | CELP-16 | CELP-1024 |
|---|---|---|---|
| 1.0 | 4.4 | 13.2 | 102.3 |

While only certain preferred features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A linear predictive codeword excited speech synthesizer comprising:

linear predictive code analysis means for receiving an input speech signal and generating therefrom a set of linear predictive filter coefficients;

codeword selection means responsive to said linear predictive code analysis means for generating a codeword index;

inverse filter means responsive to said input speech signal and said linear predictive code analysis means for generating a residual speech signal output;

pitch detector means responsive to said inverse filter means for generating pitch lag and pitch tap gain output signals;

frame buffer means for receiving and storing samples of said input speech signal and said residual speech signal output;

pitch epoch position detector means responsive to said pitch detector means for operating on stored input and residual speech signals in said frame buffer so as to detect a point of maximum excitation over a pitch cycle;

gain estimator means for generating a gain output signal in response to segments of said stored input and residual speech signals in said frame buffer means; and means for transmitting said linear predictive filter coefficients, said codeword index, said pitch lag and pitch tap gain output signals, and said gain output signal.

2. The linear predictive codeword excited speech synthesizer recited in claim 1, wherein said gain estimator means comprises means for calculating gains of the input speech signal and residual speech signal segments stored in said frame buffer means by computing the root-mean-square energy for one pitch period of the input and residual speech signals.

3. The linear predictive codeword excited speech synthesizer recited in claim 1, wherein said codeword selection means comprises:

an all-pole linear predictive coefficient synthesis filter responsive to said linear predictive code analysis means for producing a filter transfer function that closely resembles a gross spectral shape of the input speech signal;

a codebook for providing a selected output signal;

multiplier means for multiplying said selected output signal by an RMS residual speech gain produced by said gain estimator means to supply an excitation sequence input to said synthesis filter;

subtraction means for subtracting an output signal of said synthesis filter from input speech segment signals stored in said frame buffer means to produce an error signal; and error minimizer means for generating said codeword index in response to said error signal produced by said subtraction and for feeding back said codeword index to said codebook.

4. The linear predictive codeword excited speech synthesizer recited in claim 3, wherein said codebook is comprised of vectors 120 samples long.

5. The linear predictive codeword excited speech synthesizer recited in claim 1, further comprising:

means for receiving said filter coefficients, said codeword index, said pitch lag and pitch tap gain output signals, and said gain output signal;

codebook means responsive to said codeword index and said pitch lag output signal for generating a codeword output signal;

beta lock means for modifying said codeword output signal in response to said pitch tap gain output signal;

quadratic gain matching means for generating an exciting signal in response to said gain output signal and the modified codeword output signal produced by said beta lock means; and synthesis filter means responsive to said quadratic gain matching means and controlled by said linear predictive filter coefficients for generating an output speech signal replicating said input speech signal.

6. A method for operating a linear predictive codeword excited speech synthesizer, said synthesizer including linear predictive code analysis means for receiving an input speech signal and generating therefrom a set of linear predictive filter coefficients, an all-pole linear predictive coefficient synthesis filter responsive to said linear predictive code analysis means for producing a filter transfer function that closely resembles a gross spectral shape of the input speech signal, and a codebook for providing a selected output signal, said method comprising:

analyzing the input speech signal to produce said set of linear predictive filter coefficents;

applying said linear predictive filter coefficents to said synthesis filter to generate said filter transfer function;

searching said codebook to produce an output signal therefrom;

multiplying said output signal from said codebook by a gain factor to generate an excitation sequence input signal for said synthesis filter;

subtracting the output signal of said synthesis filter from a speech samples input signal to produce a codeword index;

choosing a new excitation codeword at a start of each frame of voiced speech, in synchronism with an output pitch period; and exciting said synthesis filter with a first P samples of said codeword, where P is the fundamental or pitch period of the input speech signal, the P samples being repeatedly played out to said synthesis filter to create a synthetic voiced output signal.

* * * * *